US008776415B2

(12) United States Patent
Kawaguchi et al.

(10) Patent No.: US 8,776,415 B2
(45) Date of Patent: Jul. 15, 2014

(54) UPRIGHT DISPLAY

(75) Inventors: Toyoma Kawaguchi, Tokyo (JP); Eiichirou Nonomiya, Katano (JP)

(73) Assignee: Global Pop Group Pty Ltd, South Australia (AU)

( * ) Notice: Subject to any disclaimer, the term of this patent is extended or adjusted under 35 U.S.C. 154(b) by 115 days.

(21) Appl. No.: 13/347,664

(22) Filed: Jan. 10, 2012

(65) Prior Publication Data

US 2012/0227297 A1 Sep. 13, 2012

(51) Int. Cl.
*G09F 15/00* (2006.01)

(52) U.S. Cl.
USPC ..... 40/610; 40/124.07

(58) Field of Classification Search
USPC ..... 206/193; 40/610, 603, 124.07
See application file for complete search history.

(56) References Cited

U.S. PATENT DOCUMENTS

| | | | | | |
|---|---|---|---|---|---|
| 2,160,724 | A | * | 5/1939 | Fletcher | 40/603 |
| 2,718,997 | A | * | 9/1955 | Shuxteau | 229/117.13 |
| 3,197,110 | A | * | 7/1965 | Neuman et al. | 229/244 |
| 3,234,682 | A | * | 2/1966 | Ernest | 446/85 |
| 3,258,152 | A | * | 6/1966 | Cameron | 206/166 |
| 3,469,736 | A | * | 9/1969 | Walker | 206/193 |
| 3,570,376 | A | * | 3/1971 | Overton et al. | 52/38 |
| 4,790,714 | A | * | 12/1988 | Schnapp | 446/486 |
| 4,794,024 | A | * | 12/1988 | Crowell et al. | 428/12 |
| 4,989,390 | A | * | 2/1991 | Moore, III | 52/831 |
| 5,212,898 | A | * | 5/1993 | Dinan et al. | 40/607.12 |
| 5,347,772 | A | * | 9/1994 | Ishimaru et al. | 52/167.1 |
| 5,787,621 | A | * | 8/1998 | Leksell | 40/607.03 |
| 5,787,624 | A | * | 8/1998 | Gerum | 40/706 |
| 5,966,857 | A | * | 10/1999 | Pettersson et al. | 40/606.12 |
| 6,347,772 | B1 | * | 2/2002 | L'Hotel | 248/174 |
| 6,896,577 | B1 | * | 5/2005 | Feng | 446/486 |
| 7,252,107 | B2 | * | 8/2007 | Chu et al. | 135/126 |
| 7,437,842 | B2 | * | 10/2008 | Sgambellone | 40/539 |
| 7,634,865 | B2 | * | 12/2009 | L'Hotel | 40/610 |
| 7,726,054 | B2 | * | 6/2010 | Mestres Armengol et al. | 40/124.07 |
| 8,099,883 | B2 | * | 1/2012 | Mestres Armengol et al. | 40/124.07 |
| 8,291,631 | B2 | * | 10/2012 | Wilder | 40/661.09 |

* cited by examiner

*Primary Examiner* — Charles A Fox
*Assistant Examiner* — Shin Kim
(74) *Attorney, Agent, or Firm* — Defillo & Associates, Inc; Evelyn A. Defillo

(57) ABSTRACT

An upright display includes a display main body made of display sheets each having a display face, connected so that the sheets can be folded into flat and unfolded into a tubular shape. A retaining member is located in the display main body to retain the display main body in the unfolded state. The retaining member may be folded into flat and unfolded into a tubular shape. The retaining member is in contact with rear faces of the display sheets in such a state that at least one part of the retaining member is fixed to the rear faces of the display sheets. An elastic member urges the retaining member in such a direction that the retaining member can be folded into a tubular shape.

8 Claims, 24 Drawing Sheets

UPRIGHT DISPLAY

TECHNICAL FIELD

The present invention relates to an upright display which can easily be stood for use on the surface of floor, etc. at storefront, in a store, a showroom, an exhibition hall and the like, and can be simply removed.

TECHNICAL BACKGROUND

As described in, for example, JP-A-2003-530602 (FIGS. 16 and 17) and JP-A-2005-10498 (FIGS. 1 and 4 to 6), as a display for POP advertisement, self-supportable upright displays having a paperboard main body have been widely used. These displays are constructed in such a manner that when used, a main body folded into flat is unfolded into a tubular shape and allowed to stand, and when not used, the main body unfolded into a tubular shape is folded into flat and can be transported, stored, etc.

JP-A-2003-530602 (FIGS. 16 and 17) describes an information display structure comprising a main body made of two sheets having display faces formed thereon, wherein both ends of the sheets are connected so that the main body can be folded into flat and unfolded into a tubular shape; a center fabricating part and a fabrication end part which are protruded inwardly from both side ends of the sheets; and an elastic belt laid across therebetween. This information display structure has the above construction, and when one side of the main body folded into flat is grasped and lifted up, the main body is unfolded by the action of the elastic belt and forms a tube with each sheet projected into a circular shape, whereby the main body can stand on the floor, etc. And, when the two sheets are compressed in such a direction that the sheets overlap each other, the main body can be folded into flat. However, since this upright display is unfolded simply by pulling the two sheets by the elastic belt, there is a possibility that the two sheets cannot be securely unfolded.

Further, the display for exhibition described in JP-A-2005-10498 (FIGS. 1 and 4 to 6) comprises a main body made of two sheets of which both side end portions are connected; and a flat spring of a substantially V-shape in cross-section fixed to the inner face of each of the side end portions of the main body, wherein the main body folded into flat can be expanded and kept in a tubular shape by the unfolding force of this flat spring. However, when the main body (sheet) is formed to have a large width, it is impossible to enforce the unfolding force throughout the overall width simply by expanding the inner faces of both side end portions of the main body, and therefore the main body cannot be unfolded widely. In addition, as the above upright display, various types have been proposed, but fully satisfactory ones are few, because of complicated construction, or troubles at the time of folding and unfolding.

SUMMARY OF THE INVENTION

The problems to be solved by the present invention is to provide an upright display which has a simple construction and is easy in handling, and wherein, even if the main body is formed to have a large width, the whole body can be securely unfolded into a tubular shape and the unfolded state can be maintained.

The present invention provides an upright display comprising a display main body made of display sheets each having a display face, connected so that the sheets can be folded into flat and unfolded into a tubular shape; and a retaining member disposed in the display main body to retain the display main body in the unfolded state, wherein the retaining member is formed in such a manner that it can be folded into flat and unfolded into a tubular shape, and the retaining member is in contact with rear faces of the display sheets in such a state that at least one part of the retaining member is fixed to the rear face of the display sheet, and in the retaining member, an elastic member urging the retaining member in such a direction that the retaining member can be unfolded into a tubular shape is disposed.

The upright display of the present invention is constructed as above, and comprises a display main body made of display sheets each having a display face, connected so that the sheets can be folded into flat and unfolded into a tubular shape; and a retaining member disposed in the display main body to retain the display main body in the unfolded state, wherein the retaining member is formed in such a manner that it can be folded into flat and unfolded into a tubular shape, and the retaining member is in contact with rear faces of the display sheets in such a state that at least one part of the retaining member is fixed to the rear faces of the display sheets, and, in the retaining member, an elastic member urging the retaining member in such a direction that the retaining member can be folded into a tubular shape is disposed. Accordingly, when the display main body folded into flat is expanded, the retaining member is unfolded into a tubular shape by the action of the elastic member, and the display sheet being in contact with the retaining member is expanded, and as the result, even with the display main body formed to have a large width, its whole body can be securely unfolded into a tubular shape. The above construction is very simple, and folding and unfolding operations can be easily made in handling. Further, the unfolded state of the display main body can be more securely maintained by disposing a retaining member by connecting a plurality of plates in a foldable fashion to constitute a tubular body, forming a restraint plate with its one end being connected to the plate and another end being a free end in the tubular body, and disposing the free end of the restraint plate so as to abut on the inner face of an opposite plate when the retaining member is unfolded.

PREFERRED EMBODIMENTS OF THE INVENTION

Figure 1:
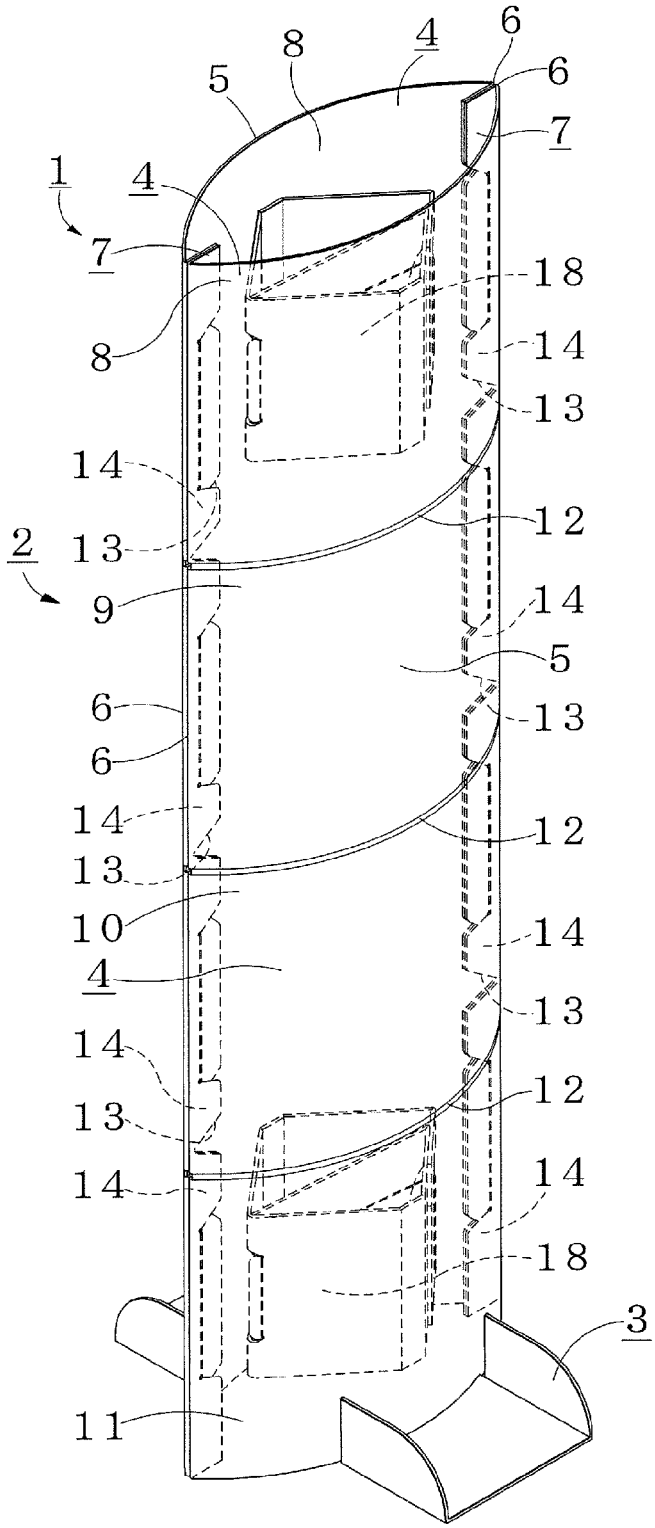
FIG. 1 is a perspective view showing an unfolded and retained state of an example of the present invention.

FIG. 1 shows an example of the present invention, and upright display 1 has a longitudinal display main body 2 and a foot member 3 for allowing the main body 2 to stably stand on the floor surface, etc. The display main body 2 alone may be used as an upright display without using such a foot member.

The display main body 2 is constituted by two paperboard display sheets 4 formed in a rectangular shape. On the surface of each display sheet 4, a display surface 5 is formed which displays information such as advertisement, publicity or exhibition. At both side ends of each display sheet 4, fold lines 6 are formed so that each side end portion can be turned inwardly, and a side end edge 7 is formed by turning each side end portion inwardly along the fold line 6. And, by putting the opposite side end edges 7 together to connect respective display sheets 4, the display main body 2 is formed. On each display sheet 4, three fold lines 12 are formed across each display sheet 4 so that the main body 2 can be folded into four zones in the vertical direction, namely, zones divided into the first zone 8, the second zone 9, the third zone 10 and the fourth zone 11 from the top (reference can be made to FIG. 6). The display main body may be formed by preparing a one-piece wide display sheet as the display sheet, folding it into two and forming the above-mentioned side end edges at its front ends, respectively, and connecting the side end edges together (not shown).

Figure 2:
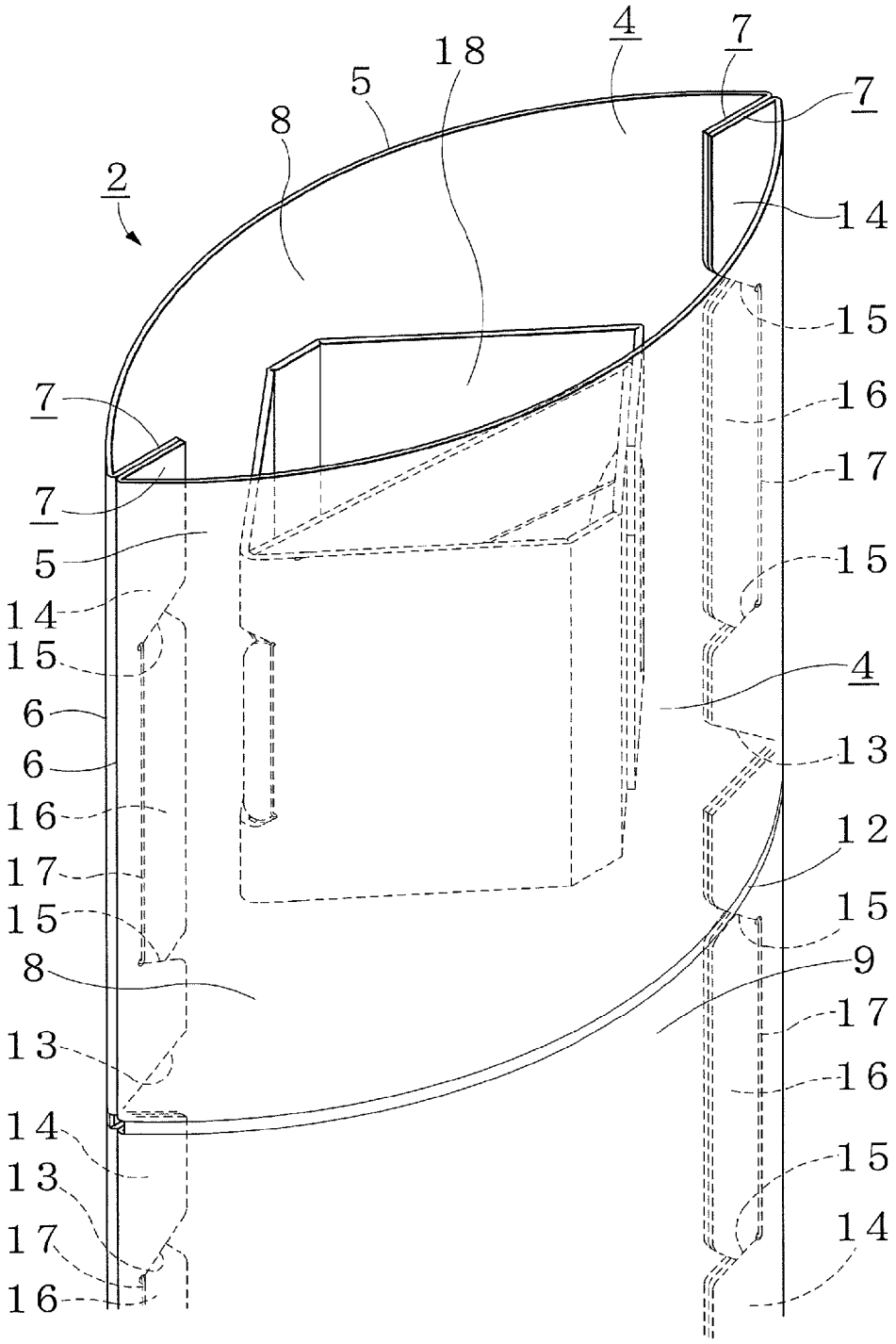
FIG. 2 is an enlarged view of an upper part in the example shown in FIG. 1.
Figure 3A:
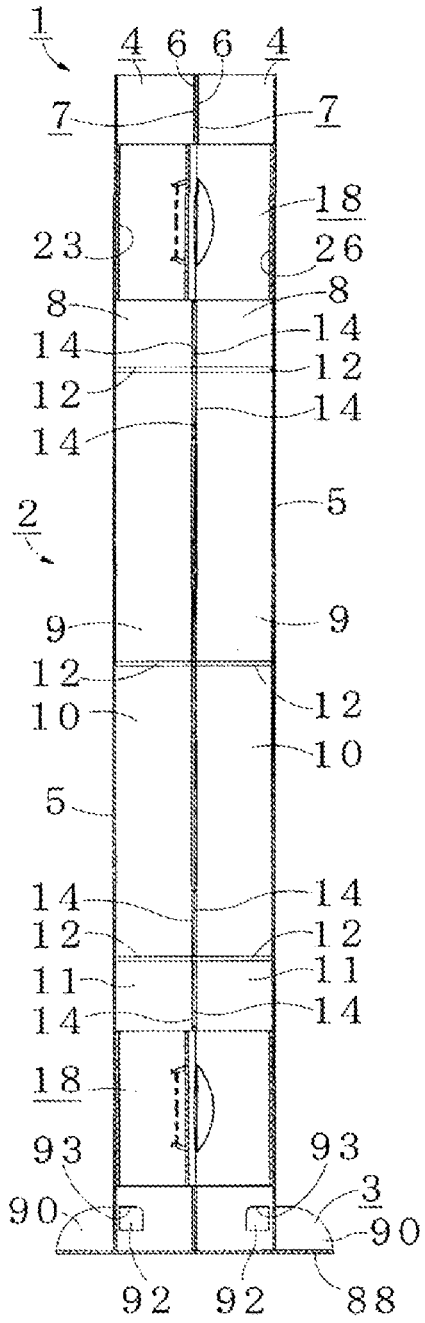
FIG. 3 shows a side cross-sectional view of the example shown in FIG. 1, wherein (A) is a cross-sectional view of the whole body and (B) is an enlarged view of its upper part.
Figure 3B:
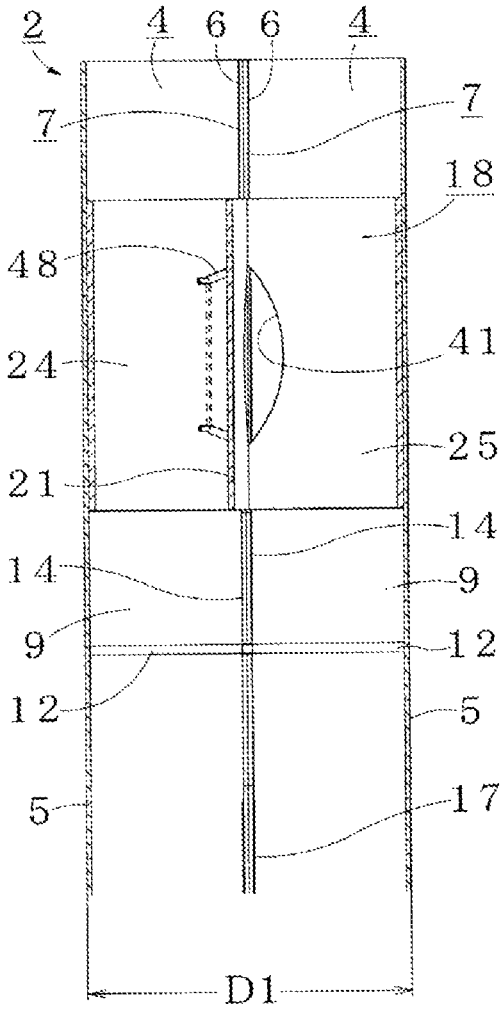
Figure 4:
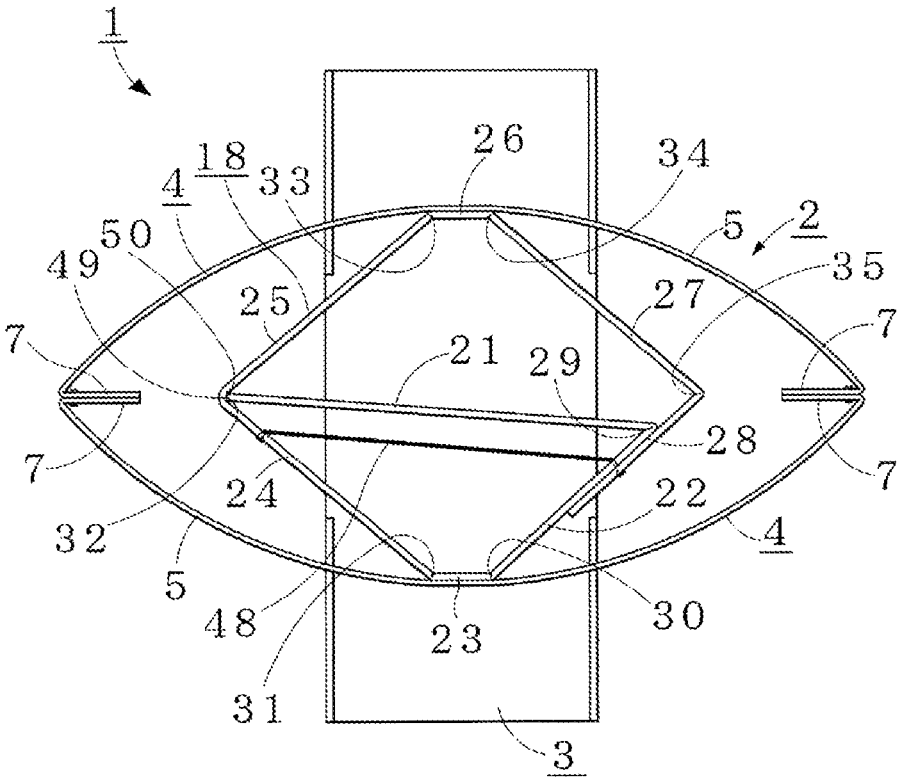
FIG. 4 is a plane view of the example shown in FIG. 1.
Figure 5A:
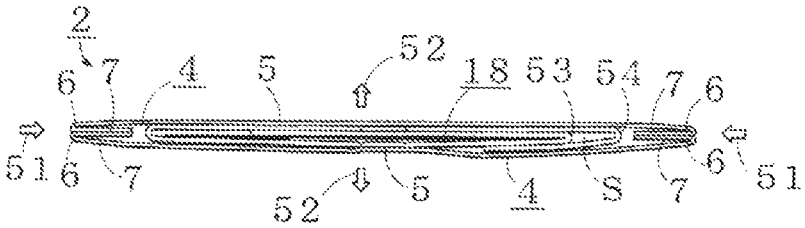
In FIG. 5, (A) is a plane view showing a flat folded state of the example in FIG. 1 and (B) is an enlarged view of the right-hand side part in (A).
Figure 5B:
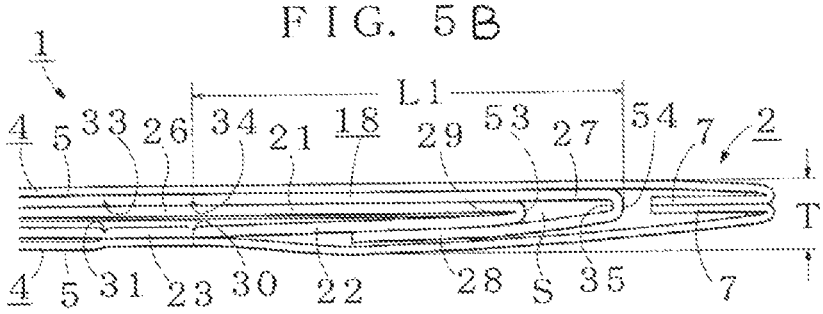

The side end edge 7 will be described below in more detail. The side end edge 7 is provided with a substantially V-shaped cut 13 at three portions so that it can be divided into four parts corresponding from the first zone 8 to the fourth zone 11, and one side end edge 7 is thereby partitioned into four side tabs 14. As shown in FIG. 2, each side tab 14 is provided with two slant cuts 15 and a lug 16 is formed between the slant cuts 15. And, as mentioned above, the side end edge 7 of one display sheet 4 and the side end edge 7 of another display sheet 4 are put together, and a rubber band 17 is wound between the upper and lower slant cuts 15 to fasten basal parts of respective lugs 16. In this manner, the main body 2 can be unfolded into a substantially tubular shape via respective fold lines 6 as shown in FIGS. 1 to 4, and can be unfolded into a substantially flat state as shown in FIG. 5.

Inside the display main body 2, a retaining member 18 is provided to retain the main body under the state as unfolded into a tubular shape. The retaining member 18 is formed in such a manner that it can be folded into flat (FIG. 5) or unfolded into a tubular shape (FIGS. 1 to 4 and 7), and is fixed at the intermediate portion in the lateral direction on both rear faces of the first zone 8 and both rear faces of the fourth zone 11, respectively. With the retaining member 18 shown in the drawings, both of the two parts which are in contact with the rear faces of the display sheet (zone) are fixed to the rear faces of the display sheet, but it is sufficient to keep the retaining member in contact with the rear face of the display sheet in such a state that at least one part is fixed to the rear face of the display sheet. The retaining member 18 has a pair of support plate parts 19 foldable (FIG. 5) or unfoldable (FIGS. 1 to 4 and 7) in oppositely disposed state.

The retaining member 18 may have various structures. A pair of support plate parts 19 may be made of independent different members, and in the examples shown in FIGS. 7 to 10, continuously formed by bending a base plate 20 made of one-piece substantially rectangular corrugated cardboard. The base plate 20 has a restraint plate 21 at one side end portion, and the restraint plate 21 has an inner support plate element 22, a fixing plate 23, a support plate element 24, a support plate element 25, a fixing plate 26, a support plate element 27, and a connecting plate 28 continuously disposed via bend parts (bend lines) 29, 30, 31, 32, 33, 34 and 35 as shown in FIG. 9. The support plate elements 24, 25 and 27 are formed in substantially the same length L1, the restraint plate 21 is formed longer than L1, and the inner support plate element 22 is formed a little shorter than L1. The connecting plate 28 is formed a little shorter than the inner support plate element 22, and the fixing plate 23 and 26 are formed shorter than the connecting plate 28. The restraint plate 21 and inner support plate element 22 are provided with a cutaway hole 38 to form a lock part 37 via lock grooves 36 and 36. Similarly, the support plate element 24 and support plate element 25 are provided with a cutaway hole 41 to form a lock part 40 via lock grooves 39 and 39, and the support plate element 27 and connecting plate 28 are provided with a cutaway hole 44 to form a lock part 43 via lock grooves 42 and 42. In FIG. 9, at the upper end portion of the restraint plate 21, a cutaway 45 of a substantially elliptical circular shape is provided.

Figure 7:
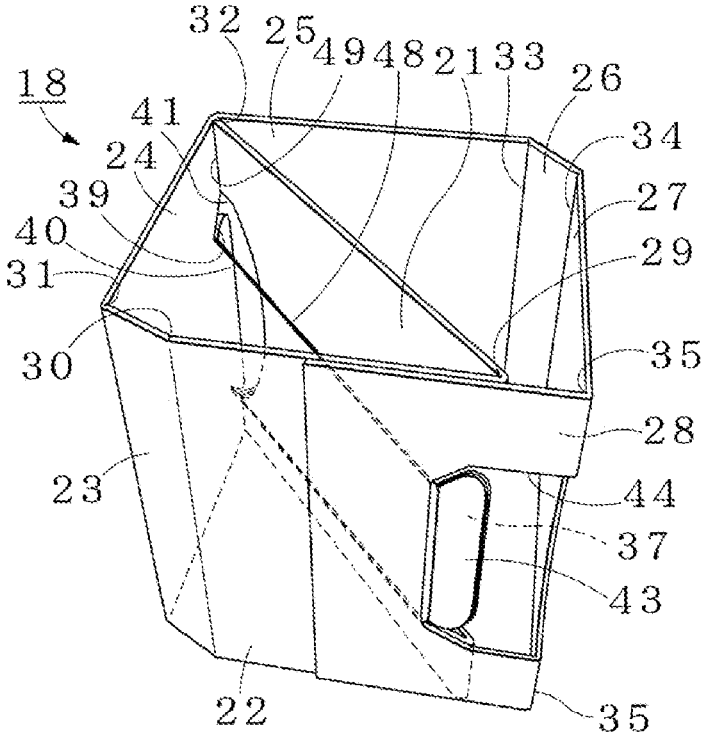
FIG. 7 is an explanatory view of the retaining member in the example of FIG. 1.
Figure 8:
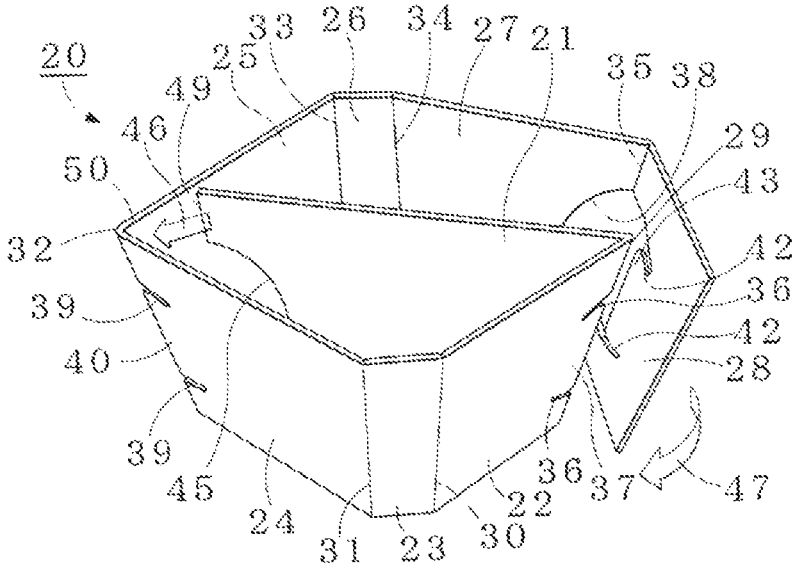
FIG. 8 is an explanatory view for a base plate of the retaining member of FIG. 7.
Figure 9:
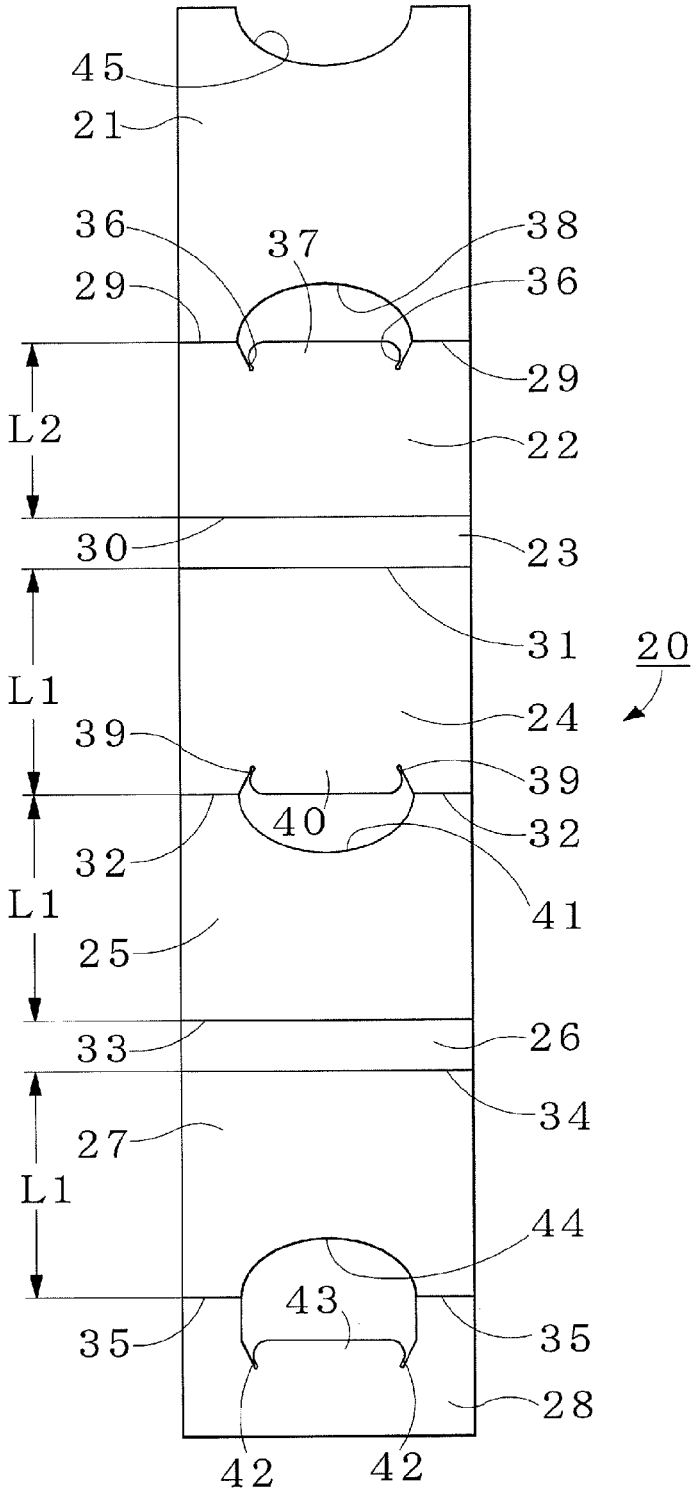
FIG. 9 is an explanatory view of the base plate of the retaining member of FIG. 7, in an unrolled state.
Figure 10:
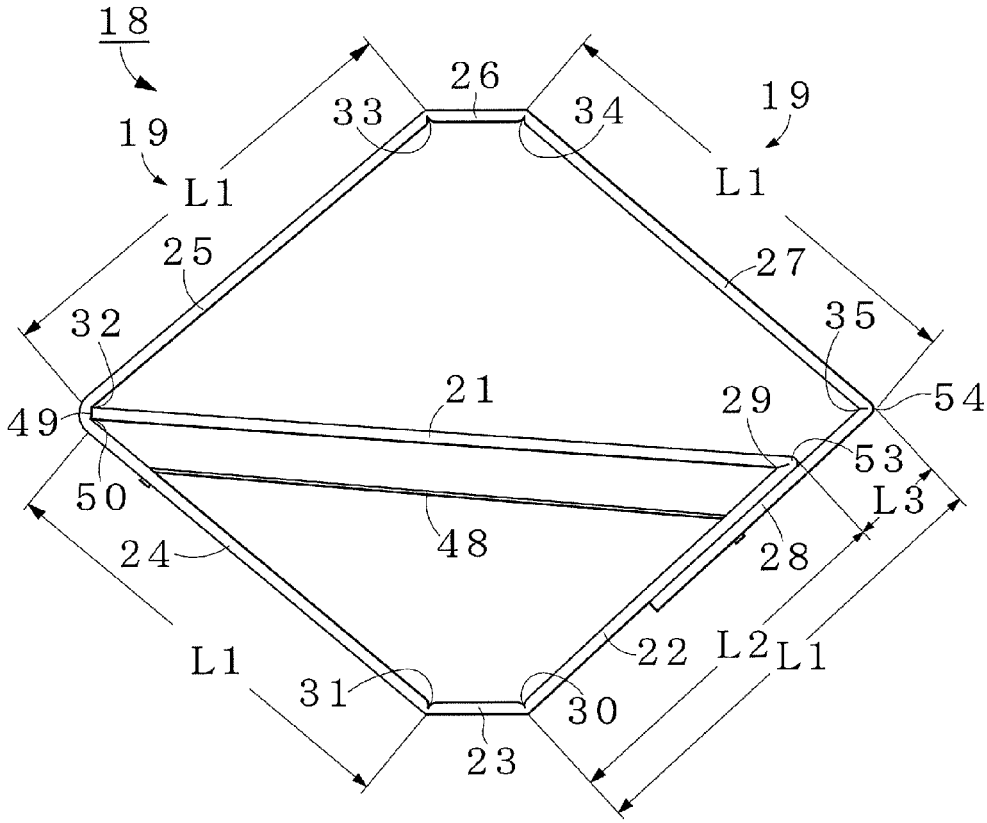
FIG. 10 is a plane view showing the retaining member of FIG. 7.

And, a tubular body is formed by bending the base plate 20 as shown in FIG. 8 so that the restraint plate 21 is placed inside. Namely, the tubular body is formed by bending in the direction of an arrow 46 the restraint plate 21 of which the front end is a free end and the basal end is connected to the inner support plate element 22; rolling the respective plate elements 22, 23, 24, 25, 26, 27 and 28 in the direction of an arrow 47 so that the circumference of the restraint plate 21 will be surrounded in a substantially hexagonal shape as seen in plane view; folding the forward end portion of the connecting plate 28 on the outside of the inner support plate element 22; and laying the lock part 43 of the connecting plate 28 over the lock part 37 of the inner support plate element 22 (FIG. 7). In such way, each restraint member 18 comprises one support plate part 19 which is constituted by support plate elements 24 and 25 and unfoldable via the fold part (bend part) 32; and another support plate part 19 which is constituted by the inner support plate element 22 connected to the restraint plate 21, the connecting plate 28 which is connected to the restraint plate 21 and laid over the inner support plate element 22, and the support plate element 27 connected to the connecting plate 28 and unfoldable via the fold part (bend part) 35, wherein the support plate parts 19 are disposed oppositely and the restraint plate 21 projects inwardly within a pair of support plate parts 19. As shown in FIG. 10, the length of one support plate part 19 is the total of the length L1 of the support plate element 24 and the length L1 of the support plate element 25. The length of another support plate part 19 oppositely disposed to this support plate part 19 is the total of the length L1 of the support plate element 27 and the length L1 as the total of the inner support plate element 22 and the connecting plate 28 laid over the inner support plate element 22. At this time, in the connecting plate 28, the length of the portion which does not overlap with the inner support plate element 22 is L2.

Between the support plate parts 19, specifically between the support plate element 24 and the portion of the inner support plate element 22 and connecting plate 28 in the example shown in the drawings, a ring-shaped elastic member 48 is disposed across them so that it urges the support plate element 24 and the portion of the inner support plate element 22 and connecting plate 28 in such a direction to draw each other. Namely, one end of the elastic member 48 is inserted into the lock grooves 39 and 39 of the support plate element 24, and another end is inserted into the lock grooves 36 and 42 and lock grooves 36 and 42 of the inner support element 22 and connecting plate 28. By this structure, the lock part 43 of the support plate element 24, the lock part 37 of the inner support plate element 22 and the lock part 40 of the connecting plate 28 are connected by the elastic member 48, and one support plate part 19 and another support plate part 19 are urged toward such direction that both are pulled each other. The retaining member 18 is thus constructed so that it can automatically be unfolded into a tubular shape by the action of the elastic member 48.

In the above-mentioned example, among the opposing support plate parts 19, the length L2 of the inner support plate element 22 constituting one support plate part 19 is shorter than the length L1 of the support plate element 24 constituting another support plate part 19, and the connecting plate 28 is connected in such a state that its part (frond part) is laid over the inner support plate element 22, and therefore when the retaining member 18 is unfolded as shown in FIG. 10, the restraint plate part 21 continuously disposed to the inner support plate element 22 slants in such a manner that it declines rightwardly from a forward end part 49 of the restraint plate 21 toward the basal port (bend line 29) side in FIG. 10. And, when the retaining member 18 is unfolded, the restraint plate 21 runs across the inside of the retaining member 18, and the forward end part 49 of the restraint plate 21 abuts on a valley part 50 (inner face of the bend part 32) formed by the support plate element 24 and the support plate element 25. Accordingly, each retaining member 18 is restrained so that it will not be excessively unfolded beyond the states shown in FIGS. 7 and 10.

As mentioned above, the retaining members 18 are in contact with intermediate portions in the lateral direction on both rear faces in the first zone 8 and the fourth zone 11, and are fixed to rear faces of the display sheets 4 via fixing plates 23 and 26, respectively, with an adhesive, etc. Accordingly, in the state where the main body 2 is folded into flat (FIG. 5(A)), when the main body 2 is unfolded by pressing areas around both bend lines 6 of the main body 2 in the direction of an arrow 51 or by grasping and pulling the upper end or lower end of the main body 2 in the direction of an arrow 52, each retaining member 18 fixed to the inner face of the main body 2 is automatically unfolded into a tubular shape by the action of the elastic member 48. And, when each retaining member 18 is unfolded into a tubular shape to some extent or more, the forward end part 49 of the restraint plate part 21 abuts on the valley part 50 (inner face of the bend part 32) formed by the support plate element 24 and the support plate element 25 as mentioned above, the unfolding operation of each retaining member 18 is restrained, and as shown in FIG. 4, the main body 2 is maintained in such an unfolded state that each display sheet 4 is extended in a circular shape. In the state of FIG. 4, against the action of the elastic member 48, when a reverse force is applied to the main body 2 in the direction of arrow 52, the main body 2 is folded into substantially flat.

Figure 6:
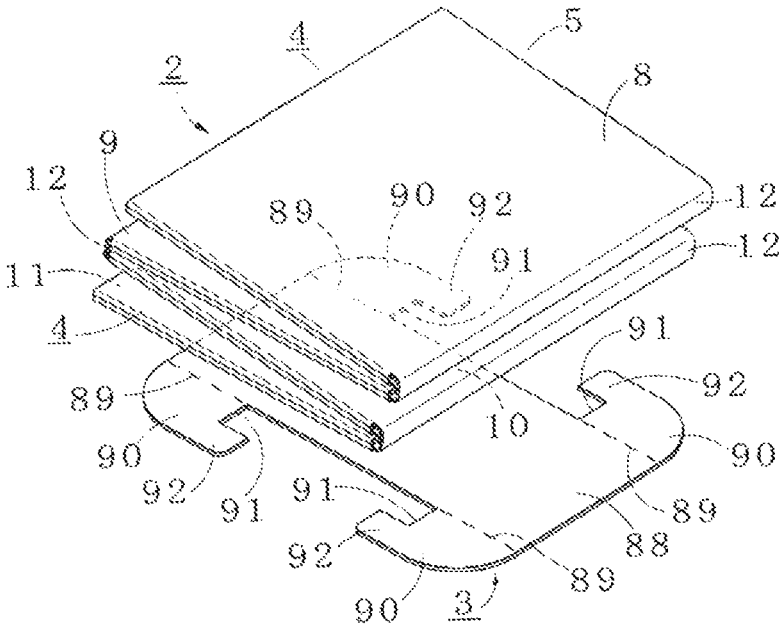
FIG. 6 is an explanatory view showing a state where the main body is laid in a folded state from which a foot member is detached.

As mentioned above, in the above example, the length of the inner support plate element 22 is shorter than the length L1 of one side of the support plate part 19, and the connecting plate 28 is connected in such a state that its part (frond part) is laid over the inner support plate element 22. Accordingly, as shown in FIG. 5, when the display main body 2 is folded into flat, an inner bend end part 53 (bend part 29) and an outer bend end part 54 (bend part 35) of the retaining member 18 do not overlap each other, and a space S is formed between the inner bend end part 53 and the outer bend end part 54, whereby the thickness of the entire main body 2 can be made thin. Further, by the formation of the space S when folded, it will not be bulky when each zone of the main body 2 is folded as shown in FIG. 6, whereby it is convenient when transported or stored.

Figure 11:
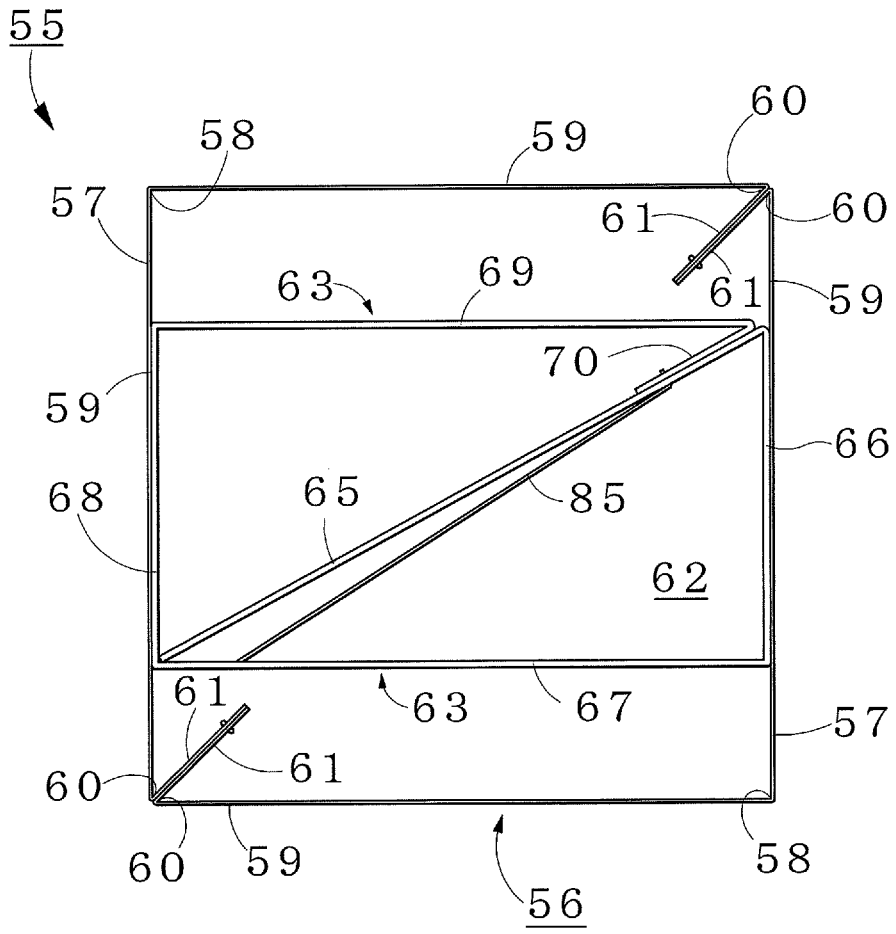
FIG. 11 is a plane view showing other example.

FIG. 11 shows other example of the upright display according to the present invention, and an upright display 55 has a display main body 56 unfoldable into a square tube shape. The display main body 56 is constituted by two display sheets 57 formed into a rectangular shape. On the surface of each display sheet 57, two display faces 59 are formed with a bend line 58 disposed at the center portion in the lateral direction of the display sheet 57. At both side ends of each display sheet 57, a bend line 60 is formed from which each side end part can be folded inwardly, and along the bend line 60, a side end edge 61 is formed by turning each side end part ditched inwardly. And, by putting the opposing side end edges 61 together to connect respective display sheets 57, the display main body 56 having four display faces 59 is formed.

Inside the display main body 56, a retaining member 62 is disposed to maintain the main body 56 unfolded into a tubular shape of a substantially quadrangular shape as seen in plane view, via the bend line 60. The retaining member 62 is formed in such a manner that it is foldable into flat (not shown) and unfoldable into a tubular shape (FIG. 11), and two portions which are in contact with the rear face of display sheet 57 are fixed to the rear faces, respectively. Here, similarly to the example shown in FIG. 1, it is enough to bring the retaining member into contact with the rear face of the display sheet in such a condition that at least one portion thereof is fixed to the rear face of the display sheet. The retaining member 62 has a pair of support plate parts 63 foldable (not shown) and unfoldable (FIG. 11) in opposite state.

Figure 12:
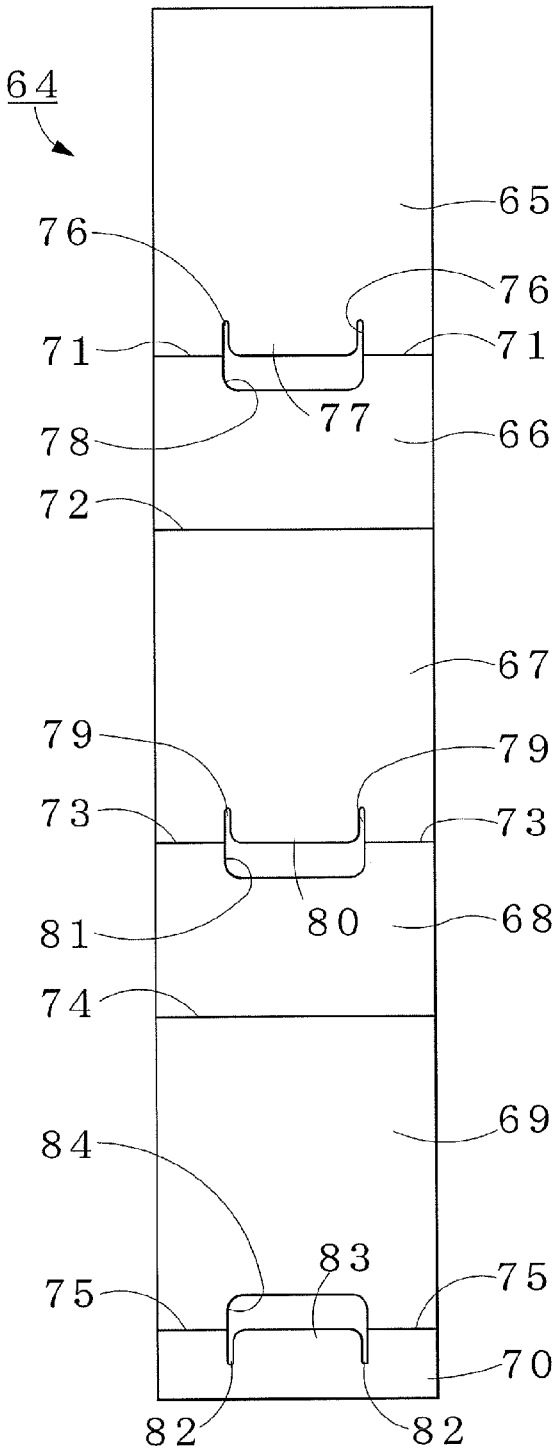
FIG. 12 is an explanatory view of the retaining member of FIG. 11, in an unrolled state.

The pair of support plate parts 63 of the retaining member 62 may be formed with independent and different members, and in the example of FIG. 11, this is continuously formed by bending a piece of base plate 64 of a substantially rectangular shape as shown in FIG. 12. The base plate 64 has a restraint plate 65 at its one side end part, and the restraint plate 65 has a fixing plate 66, a support plate element 67 constituting one support plate part 63, a fixing plate 68, a support plate element 69 constituting another support plate part 63, and a connecting plate 70 continuously disposed via bend parts (bend lines) 71, 72, 73, 74 and 75. The restraint plate 65 and the fixing plate 66 are provided with a cutaway hole 78 to form a lock part 77 via a lock groove 76. Likewise, the support plate element 67 and fixing plate 68 are provided with a cutaway hole 81 to form a lock part 80 via lock grooves 79, and the support plate element 69 and connecting plate 70 are provided with a cutaway hole 84 to form a lock part 83 via lock grooves 82.

And, respective plate elements 66, 67, 68, 69 and 70 are bent to form a tubular body in such a manner that the restraint plate 65 will exist at its inside, and an elastic member 85 is disposed in the tubular body so that the tubular body can automatically be unfolded as shown in FIG. 11. Namely, respective plate elements 66, 67, 68, 69 and 70 are enrolled to surround the periphery of the restraint plate 65 in a substantially rectangular shape as seen in plane view, and the connecting plate 70 is bent inwardly in such a manner that the lock part 84 of the connecting plate 70 is laid over the lock part 77 of the restraint plate 65 in opposing state to form a tubular body.

Between support plate parts 63, specifically between the lock grooves 79 of support plate element 67 and the lock grooves 76, 82 of restraint plate 65 and connecting plate 70 in the example shown in FIG. 11, the elastic member 85 of a ring shape is disposed across them to urge the support plate element 67, and the restraint plate 65 and connecting plate 70 to draw each other. By this structure, the lock part 80 of support plate element 67 is connected to the lock part 77 of restraint plate 65 and the lock part 83 of connecting plate 70 with the elastic member 85, and one support plate part 63 and another support plate part 63 are urged to such a direction that these are automatically unfolded. In this way, the restraint member 18 is constituted so that it is automatically unfolded into a tubular shape by the action of the elastic member 85.

As mentioned above, the retaining member 62 is in contact with an intermediate portion in the lateral direction of opposing two faces among the rear faces of the display sheet 57, and is fixed to the rear faces of the display sheets 57 via fixing plates 66 and 68, respectively, with an adhesive, etc. Accordingly, when the display main body 56 folded into flat (not shown) is unfolded, the retaining member 62 fixed to the inner face of the main body 56 is automatically unfolded into a tubular shape by the action of the elastic member 85. And, when the retaining member 62 is unfolded to the state shown in FIG. 11, a front end part 86 of the restraint plate 65 as a free end abuts on a valley part 87 (inner face of the bend part 73) formed by the support plate element 67 and fixing plate 68 as mentioned above, and therefore the unfolding operation of the retaining member 62 is restrained, and as shown in FIG. 11, each display sheet 57 of the main body 56 is expanded into a substantially right triangle shape via the bend line 60, and as a whole, unfolded into a substantially square shape. In the state shown in FIG. 11, when a force against the action of the elastic member 85 is applied to the main body 56, the main body 56 is folded into substantially flat (not shown).

Figure 13:
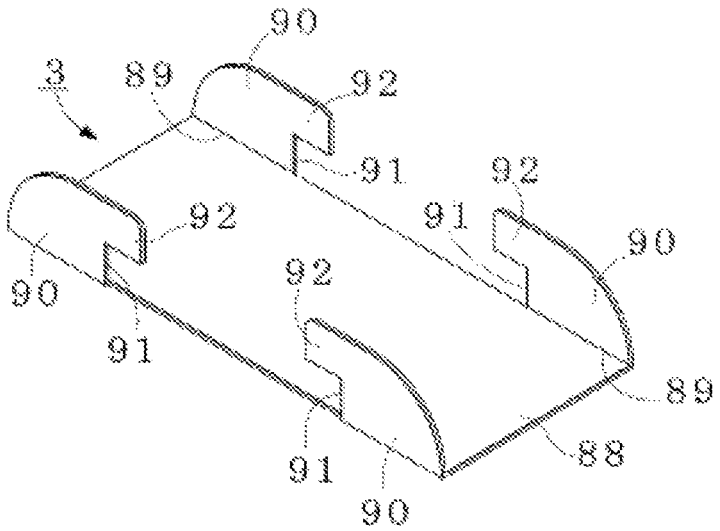
FIG. 13 is an explanatory view showing other example of a foot member.
Figure 14:
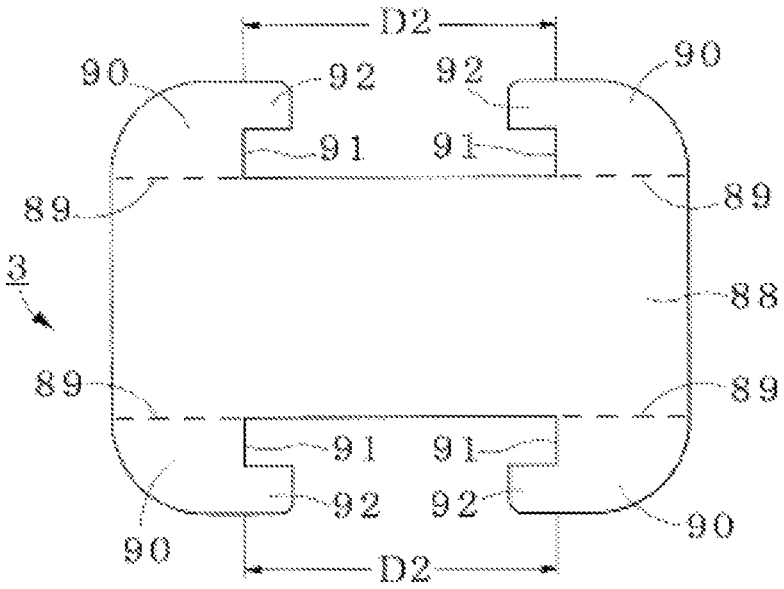
FIG. 14 is an explanatory view of the foot member of FIG. 13, in an unrolled state.

In the example shown in FIG. 1, the foot member 3 is attached to the fourth zones 11 and 11 of the display main body 2, but the foot member may be constructed in various structures as described below. The foot member 3 shown in FIGS. 13 and 14 is formed in a one-piece plate body having a rectangular floor contact plate 88, and four bend pieces 90 which are formed at the corner portions of the floor contact plate 88 via bend lines 89 and can be bent and expanded into an upright state (FIG. 1 and FIG. 13) and a flat state (FIG. 14). Each bend piece 90 is formed in a substantially L-shape as seen in plane view, and the bend piece 90 is provided with an insertion piece 92 projected in such a condition that an inward end 91 of one bend piece 90 opposes against the inward end 91 of another bend piece 90. On the other hand, in the fourth zones 11 and 11 of the display main body 2, at the position a little upper than the lower end edge of the main body 2, four slits 93 are formed so that the insertion pieces 92 can be inserted into the main body 2 (FIG. 3). And, by inserting each insertion piece 92 into each slit 93, the foot member 3 can be detachably fixed to the main body 2. Here, each inward end 91 is formed in such a manner that the distance D2 between the opposing inward ends 91 will be substantially the same as the distance D1 between respective display sheets 4 when the distance D2 is maintained by expanding the main body 2 (FIG. 1 to FIG. 4).

Figure 15:
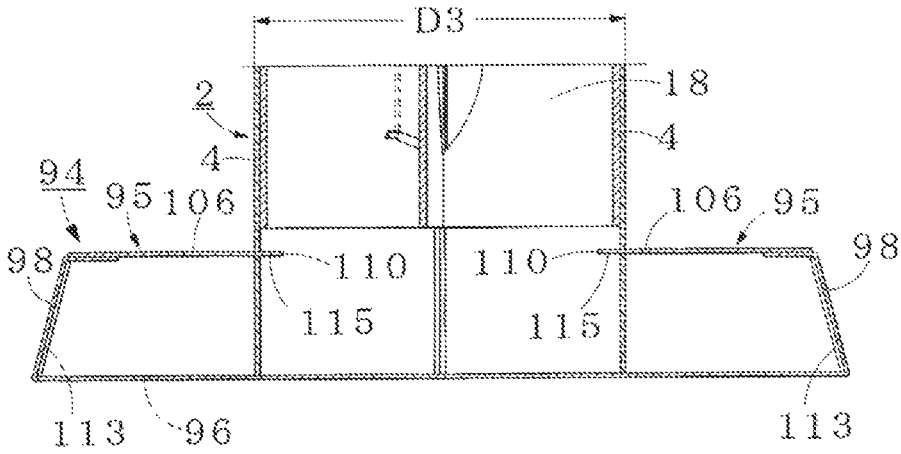
FIG. 15 is an explanatory view for other example of a foot member, and shows an installed state.
Figure 16:
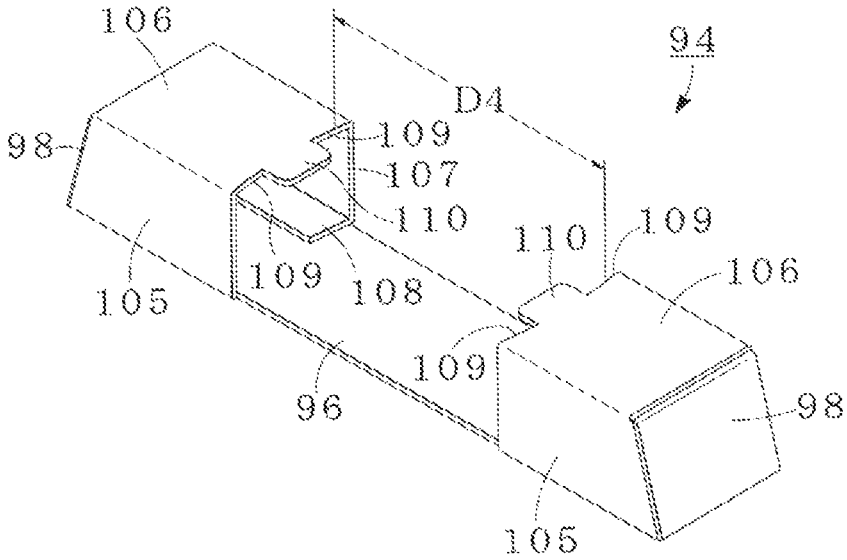
FIG. 16 is a perspective view of the foot member shown in FIG. 15.
Figure 17:
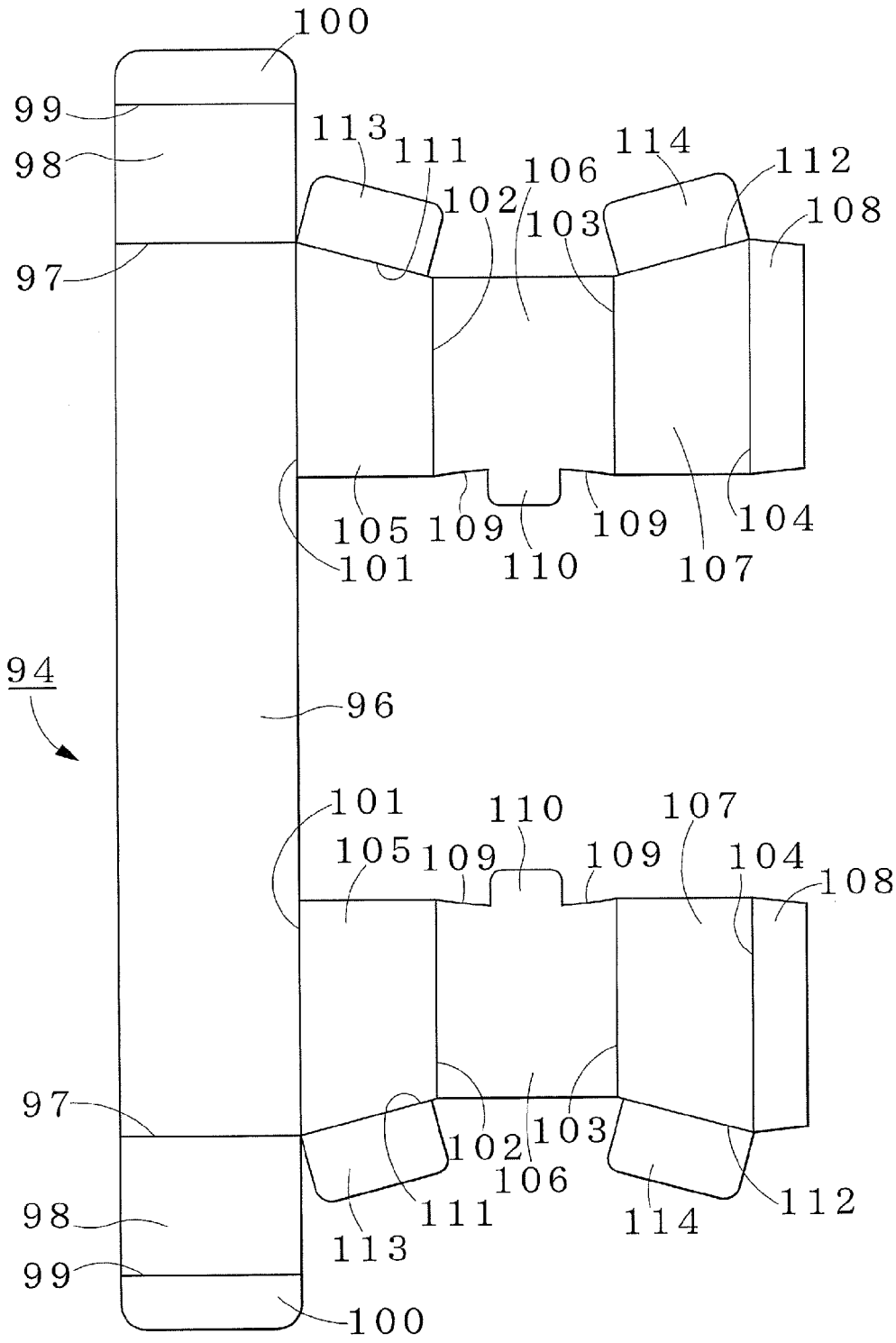
FIG. 17 is an explanatory view of the foot member shown in FIG. 16, in an unrolled state.

FIG. 15 to FIG. 17 show other example of the foot member, and when the same components as those of the example shown in FIG. 1 are represented by the same symbols as in FIG. 1, a foot member 94 is constructed so that when it is fixed to the display body 2, a box-shaped projection part 95 projects outwardly from the display main body 2. As shown in FIG. 17, the foot member 94 is obtained by bending one-piece corrugated cardboard and has a bottom plate 96 formed in a lengthy substantially rectangular shape. Each of upper and lower areas of the bottom plate 96 in FIG. 17 is provided with a lid plate 98 of a substantially rectangular shape, adjoining via a bend line 97 therebetween. And, at each of the upper and lower end parts of the lid plate 98, an insertion piece 100 extending from the upper and lower end portions of the lid plate 98, respectively, via a bend line 99, is formed. On the other hand, at both end portions of one side edge in the longitudinal direction of the bottom plate 96, are disposed continuously, a substantially trapezoidal side wall plate 105 formed at one side portion (right-hand side in FIG. 17) with the both end portions as the basal end; a substantially convex-shaped top plate 106; a side wall plate 107 which is formed in the substantially same shape as the side wall plate 105 wherein both are disposed symmetrically with the top plate 106 interposed therebetween; and a substantially trapezoidal fixing tab 108 formed to be shorter in the width than the side wall plate 107, via bend lines 101, 102, 103 and 104. The top plate 106 is provided with an insertion piece 110 projecting from its inward end 109 as the basal part and opposing to another insertion piece 110. The distance D4 between one inward end 109 and another inward end 109 is determined so that it becomes substantially the same as the distance D3 between respective display sheets 4 when the display main body 2 is unfolded and kept as it is (FIG. 15). Namely, respective inward ends 109 curve at substantially the same curvature as the curvature of circular generated by the unfolded display sheets 4 so as to follow the outer surface (display face) of respective display sheet 4 expanded in a substantially circular shape (not shown). On the slanting sides of the side wall plate 105 and side wall plate 107, ears 113 and 114 are continuously disposed, respectively, via bend lines 111 and 112 which correspond to the slanting sides.

In the foot member 94 thus constructed, the side wall plate 105, top plate 106, side wall plate 107 are bent at respective bend lines 102, 103 and 104 to cover the upper face portion of the bottom plate 96 in a substantially U-shaped form; the fixing tab 108 turned inwardly via the bend line 105 is fixed to the upper face of one side end edge of the bottom plate portion 97 along this side end edge by an adhesive, a double-sided adhesive tape, etc. to form a substantially square tubular body; respective lid plates 98 are raised upwardly with the bend line 97 as the basal end; respective insertion pieces 100 turned inwardly via the bend line 99 are inserted between the top plate 106 and the ears 113 and 114, respectively, to close opening portions of both end sides of the bottom plate 96 among the opening portions of respective tubular bodies (FIG. 15 and FIG. 16). The foot member 94 thus fabricated is fixed detachably to the main body 2 by inserting respective insertion pieces 110 into slits 115 formed at the lower end portion of the display body 112, as shown in FIG. 15.

Figure 18:
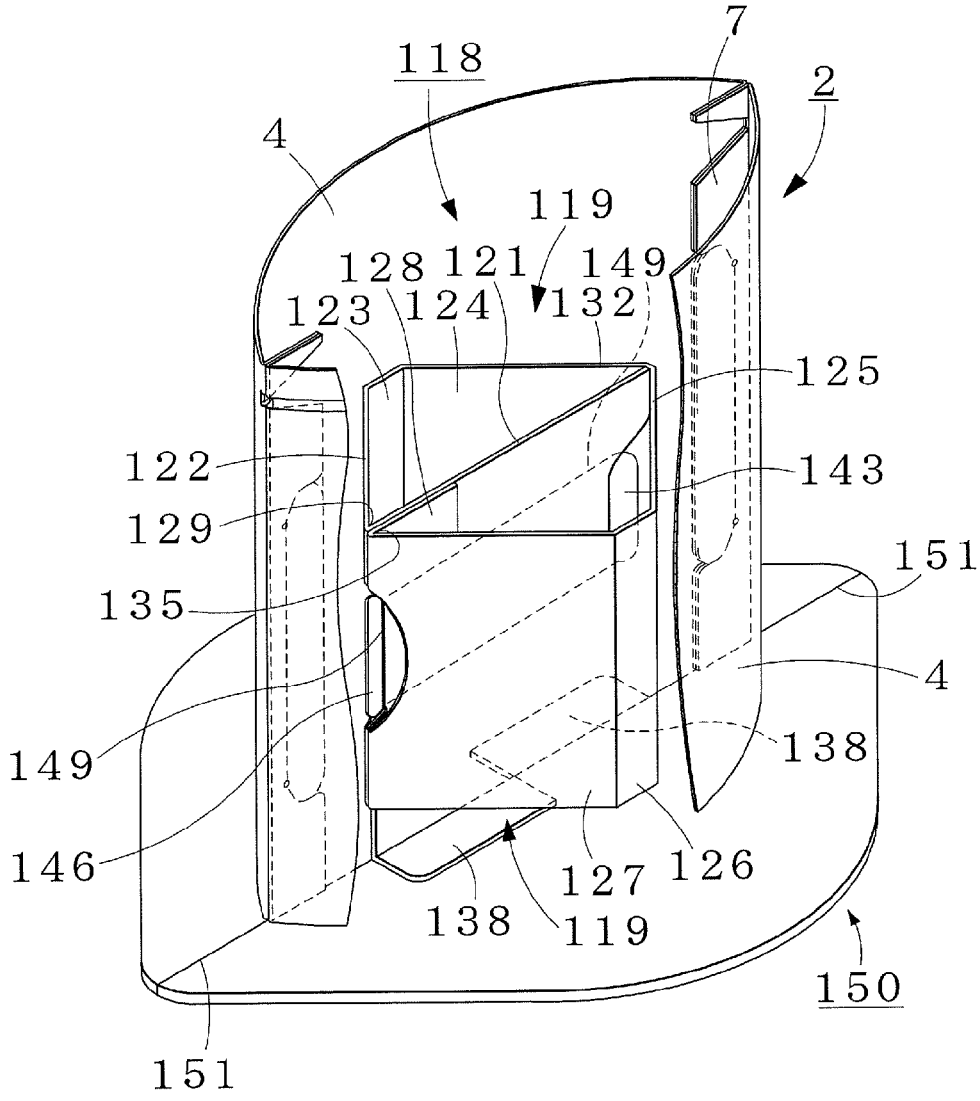
FIG. 18 is a perspective view showing other example.

FIG. 18 shows other example of the present invention, and an upright display 116 has display main body 2 and a foot member 117. Since the display main body 2 is the same as the one in the example shown in FIG. 1, its detailed explanation is omitted.

Figure 19:
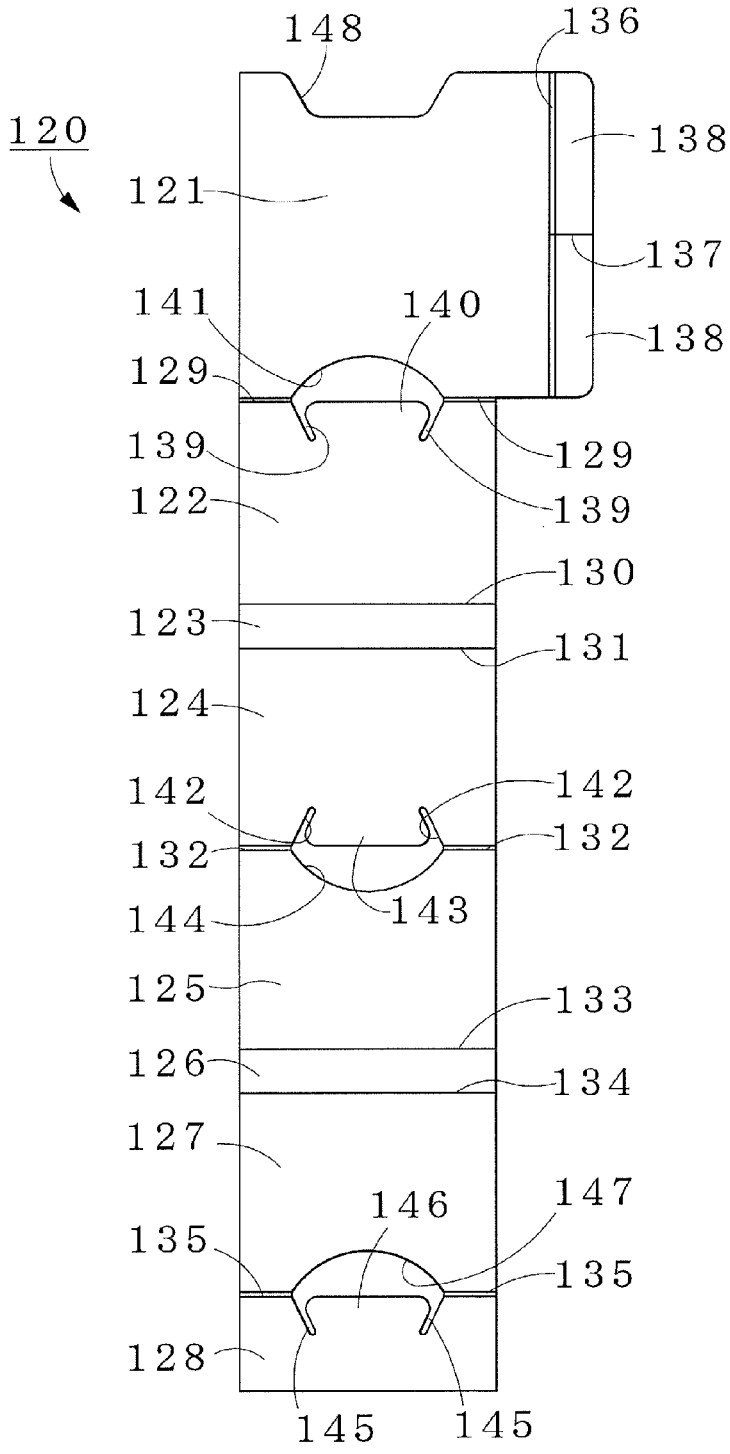
FIG. 19 is an explanatory view of the retaining member shown in FIG. 18, in an unrolled state.

Inside the display main body 2, a retaining member 118 is disposed so that the main body 2 unfolded into a tubular shape can be maintained as it is. The retaining member 118 has the substantially same structure as the example shown in FIG. 1, different points will be explained in detail. The retaining member 118 has a pair of foldable (not shown) and unfoldable support plate part 119. Respective support plate parts 119 may be formed with independent and different members, but in the example shown in FIG. 18 to FIG. 20, this part is continuously formed by bending one-piece base plate 120 formed in a substantially rectangular shape as shown in FIG. 19. The base plate 120 has a restraint plate 121 at its side end portion, and the restraint plate 121 has a support plate element 122, a fixing plate 123, a support plate element 124, a support plate element 125, a fixing plate 126, a support plate element 127 and a connecting plate 128, formed continuously via bend parts 129, 130, 131, 132, 133, 134 and 135. In FIG. 19, the restraint plate 121 is formed to be long towards the right-hand side so that it can extends downwardly when it is fabricated, and the lower end part of the restraint plate 121 is provided with two fixing pieces 138 which can be bent in opposite direction each other via a crease 136 and a broken line 137. The restraint plate 121 and the support plate element 122 are provided with a cutaway hole 141 to form a lock part 140 via lock grooves 139 and 139. Similarly, the support plate element 124 is provided with a cutaway hole 144 to form a hook piece 143 via lock grooves 142 and 142, and the support plate element 127 and connecting plate 128 are provided with a cutaway hole 147 to form a lock part 146 via lock grooves 145 and 145. At the upper portion of the restraint plate 121 in FIG. 19, a cutaway 148 of a substantially elliptical circular shape is formed.

Then, the base plate 120 is bent to form a tubular body so that the restraint plate 121 will exist inside. Namely, the restraint plate 121 of which the front end is a free end and the basal end is connected to the support plate element 122 is bent, respective plates 122, 123, 124, 125, 126, 127 and 128 are enrolled so that the periphery of the restraint plate 121 will be surrounded in a substantially hexagonal shape as seen in plane view, and the connecting plate 128 bent inwardly is laid over the restraint plate 121 and connected. At this time, the restraint plate 121 and connecting plate 128 are positioned inside the tubular body. In such way, the retaining member 118 comprises one support plate part 119 which is constituted by support plate elements 124 and 125 and can be unfolded via the fold part (bend part) 132; and another support plate part 119 which is constituted by the support plate element 122 continuously connected to the restraint plate 121 and the support plate element 127 can be unfolded via the fold parts (bend parts) 129 and 135, wherein the support plate parts 119 are disposed oppositely. Between the support plate parts 119, specifically between the support plate element 124 (lock part 143) and the support plate element 122 and support plate element 127 (lock part 140 and lock part 146 laid over the lock part 140) in the example as shown in the drawings, an elastic member 149 is disposed across therebetween.

Figure 20:
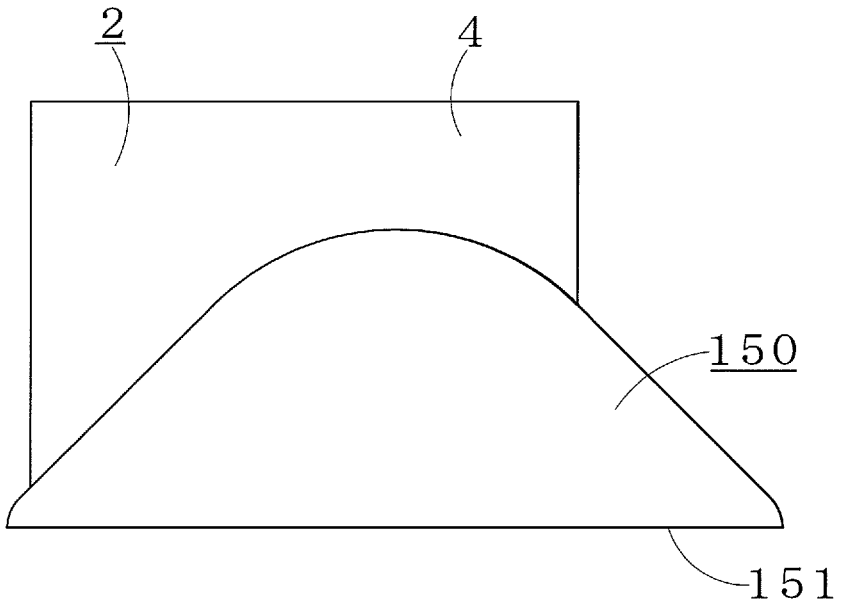
FIG. 20 is an explanatory view showing a flat folded state of the one shown in FIG. 18.

The foot member 117 positioned at the lower end of the display main body 2 has an area larger than the unfolded area of the main body 2 and is provided with a foot member 150 formed in a plate shape of a substantially lemon-shape, or the like, as shown in FIG. 18. The foot main body 150 has one fold line 151 partitioning it into two areas, by which it can be folded into the state as shown in FIG. 20 when the display main body 2 is folded into flat, and the fixing pieces 138 bend in opposite direction each other are fixed to respective areas on both sides of the fold line 151. Accordingly, when the display main body 2 is folded, the retaining member 118 is folded as shown in FIG. 20 in such a manner that the portion formed in a tubular shape of the constituting elements slides toward the left-hand side in FIG. 20. When such display main body 2 folded into flat is unfolded, each display sheet expands the upper face of the foot main body 150 of the foot member 117, and the foot member 117 thereby becomes an expanded state as shown in FIG. 18, whereby the display main body 2 can be stably stood.

Figure 21:
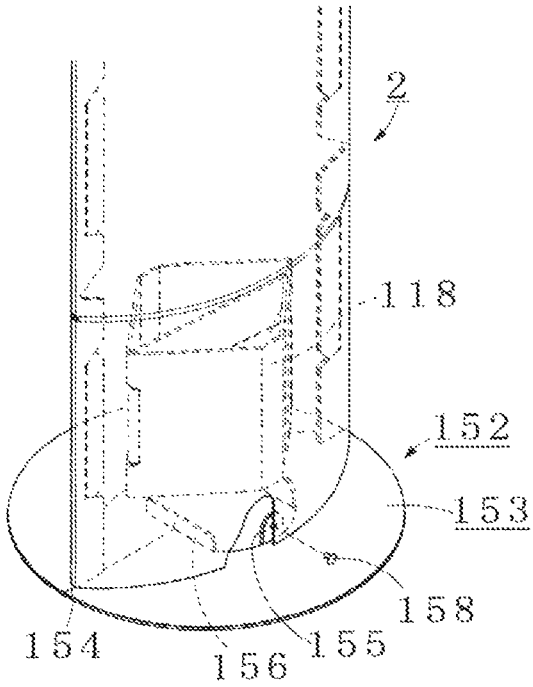
FIG. 21 is an explanatory view showing other example of a foot member.
Figure 22:
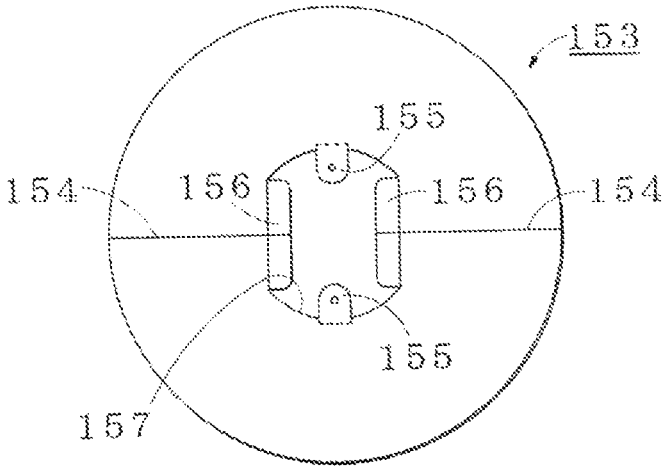
FIG. 22 is an explanatory view of a foot main body of the foot member shown in FIG. 21.

FIG. 21 and FIG. 22 show other example of the foot member, and at the lower end of the display main body 2, a foot member 152 is disposed, and the foot member 152 has a foot main body 153 of a substantially disc shape. The foot member 153 is provided with a fold line 154 partitioning the foot main body 153 into two equal parts as shown in FIG. 22 by which the foot member can be folded in half, and at the center of the foot main body 153, a cutaway hole 157 is formed by which two fixing pieces 155 and two lock pieces 156 which can be stood upwardly are formed, respectively. The foot member 152 is attached to the main body 2 by allowing the fixing pieces 155 of foot main body 153 to stand upwardly, fixing them to intermediate portions in the lateral direction at the lower end of the display sheet 4 constituting the display main body 2 with a pin 158. And, the display main body 2 folded into flat having the foot member 152 attached thereto is unfolded, the foot member 152 becomes an expanded state as shown in FIG. 21 and it becomes possible to allow the main body 2 to stably stand. Further, under this expanded state, if the lock piece 156 is stood upwardly and turned into the main body 2 inwardly, it becomes possible to securely prevent the foot member 152 from being folded. Under the expanded state as shown in FIG. 21, when the lock piece 156 is turned back and the display main body 2 is folded into flat, the foot member 152 is folded into flat in such a manner that the lower end of the main body 2 is sandwiched by the foot member 152.

In the above example, the display main body 2 is composed of two display sheets 4 connected to each other. However, the display main body may be appropriately constructed provided that it is constructed in such a manner that the main body can be folded into flat and unfolded into a tubular shape. For example, it may be composed of one-piece display sheet as mentioned above, or may be composed of three or more display sheets connected to one another. Further, as shown in FIG. 11, the display main body may be formed by bending one-piece display sheet to have plural display faces. The one shown in FIG. 1 has three fold lines 12 so that each display sheet 4 can be bent at each of four zones 8 to 11, but the number of zones and the number of bend lines arranged depending on it may be appropriately adjusted. If the case requires, a structure having no bend line may be used. Further, the number of side tabs 14 may be appropriately determined depending on the number of zones. In this example, the configuration of the main body 2 unfolded into a tubular shape and kept as it is, forms a shape made by combining circular arcs of the substantially the same curvature. However, it may have an appropriate configuration such as a shape made by combining circular arcs with different curvatures of the display faces, substantially polygonal shapes, etc. by changing, for example, the number of sheets, the number of bent lines, the shape of sheet, connecting parts of sheet or degree of opening thereof, shape of the retaining member, shrinkage of the elastic member, etc. Here, as the constituting material of the display sheet, not only the above-exemplified paperboard, but also paper materials such as corrugated cardboard, appropriate constituting materials such as a resinous material, may be used.

The retaining member may have various structures provided that it can be folded into flat and unfolded into a tubular shape via the support plate part. The shape of the tube may be an appropriate shape, for example, substantially pentagonal shape as seen in plan view, in addition to the substantially hexagonal shape as seen in plan view and substantially rectangular shape as seen in plan view which are already exemplified above. The support plate part may be a one-piece plate body as shown in FIG. 11, or may be constituted to have a plurality of support plate elements connected to one another via fold parts as shown in FIGS. 7 and 18. This retaining member may be disposed by appropriately connecting separately formed plates, but it may be formed economically by bending one-piece base plate as shown in the drawings, such being preferred. Further, the retaining member is in contact with the rear face of each display sheet, and it is sufficient that the retaining member is fixed to at least one portion of the portions at which it is in contact with the rear face of the display sheet. In the example shown in the drawings, both of the fixing plates being in contact with the rear face of each display sheet are fixed thereto. However, it is possible to fix one of them and bring another one in slidably contact with the rear face of the display sheet. For example, when the retaining member is formed in a substantially pentagonal shape as seen in plane view with plural plate parts, one plate among the plates constituting the pentagonal shape may be used as a fixing plate, and an apex part opposite to this fixing plate may be brought into slidably contact with the rear face. There is no particular limitation about the portions at which the retaining member is in contact with the rear face of the display sheet, but as shown in the drawings, if each retaining member is positioned at the intermediate portion in the lateral direction on the rear face of each display sheet, the expanding force of each retaining member will sufficiently be applied to the main body, and a main body can be securely unfolded even if it is formed to have a large width, such being preferred.

In this example, a ring-shaped elastic member is laid between support members to automatically unfold the retaining member, but, for example, the elastic member may be formed in a belt-like or string-like shape and laid across for connection between the support members. Further, as a means for restraining the main body from being excessively unfolded, various structures may be employed. For example, as shown in the drawings, a retaining member is disposed by bending one-piece base plate, and a plate positioned at one end portion of the retaining member is used as a restraint plate so that when the retaining member is unfolded to some extent, the front end portion of the restraint plate abuts on a valley portion of another support plate part among opposite support plate parts, by which the retaining member is simple in structure and can be obtained economically, and also the unfolding operation of the main body can be securely stopped. Further, as shown in the drawings, if a part of the base plate is cut away in such a manner that a part to which the elastic member is attached (the above lock part) within the retaining member will be exposed to the outside of the base plate 20, the retaining member can be simply fabricated even under the condition that one or both of the fixing plate parts are fixed to the rear face of each display face, such being preferred.

As the foot member, appropriate structures may be employed, for example, the structure wherein the foot member is disposed at the lower end of the display main body in such a fashion being freely inserted as mentioned above, the structure made of plate-like bodies in a fashion capable of being opened and closed, the structure wherein when the display main body is unfolded into a tubular shape, the foot member is expanded by the display main body, the structure wherein when the display main body is unfolded, the foot member has a lock part which can be turned into the main body, etc.

The invention claimed is:

1. An upright display comprising:

a display main body including a front display sheet and a rear display sheet, each display sheet having a display face, the display sheets are connected so the sheets are folded into a flat position and to an unfolded position; and a retaining member disposed inside the display main body to retain the display main body in the unfolded position;

wherein the retaining member includes:

a first support plate having a first support element and a second support element connected at a first bending point;

a second support plate disposed opposite to the first support plate, the second support plate having an inner support plate connected to an end of a restraint plate, a first connecting plate connected to the restraint plate and laid over the inner support element, and a support plate element connected to the first connecting plate;

an elastic member having a first end connected to the first support element and a second end connected to the inner support plate;

wherein the restraint plate includes a free end opposite to the end connected to the inner support plate, wherein the restraint plate projects inside the first and second support plates;

wherein the retaining member is folded into the flat shape and unfolded into the a tubular shape, wherein the retaining member is in contact with an intermediate portion of the rear display sheet, and wherein in the unfolded position, the elastic member urges the support plate element and the inner support plate element toward each other urging the first support plate towards the second support plate producing that the free end of the restraint plate to abut on the first bending point of the first support plate.

2. The upright display according to claim 1, further including at least one fixing plate, and wherein second support element of the first support plate and the support element plate of the second support plate are connected by one of the fixing plates, wherein first support element of the first support plate and the inner support element of the second support plate are connected by one of the fixing plates.

3. The upright display according to claim 1, wherein the display main body has a foot member at its lower end portion.

4. The upright display according to claim 3, wherein the foot member is detachably disposed at the lower end of the display main body.

5. The upright display according to claim 3, wherein the foot member comprises a plate shaped body which can be opened and closed, and when the display main body is unfolded into the tubular shape, the foot member is expanded by the display main body.

6. The upright display according to claim 5, wherein the foot member has a lock part which is turned toward the inside of the display main body when the display main body is unfolded.

7. An upright display comprising:

a display main body including a front display sheet and a rear display sheet, each display sheet having a display face, the display sheets are connected so the sheets are folded into a flat position and to an unfolded position; and a retaining member disposed inside the display main body to retain the display main body in the unfolded position;

wherein the retaining member includes:

a first support plate having a first support element and a second support element connected at a first bending point;

a second support plate disposed opposite to the first support plate, the second support plate having an inner support plate connected to an end of a restraint plate, a first connecting plate connected to the restraint plate and laid over the inner support element, and a support plate element connected to the first connecting plate;

an elastic member having a first end connected to the first support element and a second end connected to the inner support plate;

wherein the inner support plate has a length that is smaller than a length of the first support element;

wherein the restraint plate has a length that is longer than the length of the first support element;

wherein the connecting plate has a length that is smaller than the length of the inner support plate;

wherein the restraint plate includes a free end opposite to the end connected to the inner support plate, wherein the restraint plate projects inside the first and second support plates;

wherein the retaining member is folded into the flat shape and unfolded into the a tubular shape, wherein the retaining member is in contact with an intermediate portion of the rear display;

wherein in the unfolded position, the elastic member urges the support plate element and the inner support plate element toward each other urging the first support plate towards the second support plate producing that the free end of the restraint plate to abut on the first bending point of the first support plate.

8. An upright display comprising:

a display main body including a front display sheet and a rear display sheet, each display sheet having a display face, a rear face, a first side end, a second side end, a first folding line on the first side end, and a second folding line on the second side end, the display sheets are connected so the sheets are folded into a flat position and to an unfolded position;

a first side edge formed by folding the first side end inwardly at the first folding line;

a second side edge formed by folding the second side end inwardly at the second folding line;

a plurality of cuts formed through a length of each side edge;

a side tab formed between adjacent cuts on the corresponding side edge, each side tab including slanted cut edges;

the side edges of the first display sheet and the side edges of the second display sheet are connected forming a lug between adjacent slanted cut edges;

an elastic band wound between the slanted cut edges of each side tab fastening the corresponding lug;

a retaining member disposed inside the display main body to retain the display main body in the unfolded position;

wherein the retaining member includes:

a first support plate having a first support element and a second support element connected at a first bending point;

a second support plate disposed opposite to the first support plate, the second support plate having an inner support plate connected to an end of a restraint plate, a first connecting plate connected to the restraint plate and laid over the inner support element, and a support plate element connected to the first connecting plate;

an elastic member having a first end connected to the first support element and a second end connected to the inner support plate;

wherein the inner support plate has a length that is smaller than a length of the first support element;

wherein the restraint plate has a length that is longer than the length of the first support element;

wherein the connecting plate has a length that is smaller than the length of the inner support plate;

wherein the restraint plate includes a free end opposite to the end connected to the inner support plate, wherein the restraint plate projects inside the first and second support plates;

wherein the retaining member is folded into the flat shape and unfolded into the a tubular shape, wherein the retaining member is in contact with an intermediate portion of the rear display;

wherein in the unfolded position, the elastic member urges the support plate element and the inner support plate element toward each other urging the first support plate towards the second support plate producing that the free end of the restraint plate to abut on the first bending point of the first support plate.

* * * * *